US005161586A

United States Patent [19]

Auriemma

[11] Patent Number: 5,161,586

[45] Date of Patent: Nov. 10, 1992

[54] PNEUMATIC CONTROL FOR CONTAINER FILLING MACHINE

[75] Inventor: Albert A. Auriemma, South Weymouth, Mass.

[73] Assignee: Pneumatic Scale Corporation, Quincy, Mass.

[21] Appl. No.: 699,817

[22] Filed: May 14, 1991

[51] Int. Cl.[5] ..... B65B 3/26

[52] U.S. Cl. ..... 141/46; 141/40; 141/198

[58] Field of Search ..... 141/5, 6, 85, 89-92, 141/39-41, 44-64, 95, 198, 288, 301, 302, 307-309

[56] References Cited

U.S. PATENT DOCUMENTS

| | | | |
|---|---|---|---|
| 2,692,075 | 10/1954 | Day et al. | 141/62 X |
| 2,733,850 | 2/1956 | Welty et al. | 141/58 X |
| 3,313,326 | 4/1967 | Pellerino | 141/198 X |
| 3,357,461 | 12/1967 | Friendship | 141/198 X |
| 3,522,824 | 8/1970 | Allen | 141/90 |
| 3,527,267 | 9/1970 | Moore | 141/40 |
| 3,580,298 | 5/1971 | Trusselle | 141/40 |
| 3,783,912 | 1/1974 | Friendship | 141/46 |
| 3,783,913 | 1/1974 | Trusselle | 141/46 |
| 3,795,263 | 3/1974 | Wilhere | 141/198 |
| 3,893,493 | 7/1975 | Foirest et al. | 141/47 |
| 3,905,404 | 9/1975 | Cox | 141/46 |
| 3,993,111 | 11/1976 | McLennand | 141/90 |
| 4,832,093 | 5/1989 | Morrone | 141/40 |

*Primary Examiner*—Henry J. Recla
*Assistant Examiner*—Casey Jacyna
*Attorney, Agent, or Firm*—Robert M. Asher

[57] ABSTRACT

A pneumatic circuit for controlling a liquid filler. A pilot air conduit conducts high pressure air to a pilot valve and a back pressure piloted valve. The pilot valve is normally closed so as to prevent the supply of liquid product to a container. High pressure air in the pilot air conduit opens the pilot valve to actuate supply of liquid to the container. A level sensor positioned above the container being filled provides a back pressure signal to the back pressure piloted valve causing it to exhaust the high pressure pilot air from the pilot air conduit causing the pilot valve to close.

13 Claims, 2 Drawing Sheets

PNEUMATIC CONTROL FOR CONTAINER FILLING MACHINE

BACKGROUND OF THE INVENTION

The present invention is directed to a pneumatic control for automatically shutting off flow of liquid product supply to a container upon sensing that the container is filled.

There are various known automatic container filling machines wherein a sensing tube extends into a container to be filled and when the lower end of the tube is blocked by the product in the container, back pressure through the tube actuates a control device to stop the flow of product into the container. For example, in U.S. Pat. No. 3,783,913, Trusselle discloses an intricate series of valved nozzles or jets which operate in conjunction with diaphragms and trip valves in order to respond to a sensed back pressure to shut off liquid to the filling container. Another control for such a filling apparatus is disclosed in U.S. Pat. No. 4,832,093 (Morrone) in which back pressure is used to trigger an interface valve which in turn pilots a control valve to shut down the supply of fluid to the container being filled. The control circuit of the Morrone patent employs only a single air pressure source. It is an object of the present invention to provide a set of control elements which achieve improved accuracy of response to a sensed back pressure.

SUMMARY OF THE INVENTION

The present invention is directed to a pneumatic control circuit in which back pressure is fed to a low pressure piloted valve. The low pressure piloted valve is connected to a pilot air conduit. The pilot air conduit is also connected to a pilot valve unit. The pilot air opens the pilot valve to permit main air to be supplied to an air cylinder which operates a material filling valve in the filling head. Advantageously, the back pressure opens the low pressure piloted valve to exhaust the pilot air which immediately causes the pilot valve unit to close, shutting off main air to the air cylinder.

The pneumatic control of the present invention may also be supplied with a blow down circuit for clearing out the filling nozzle after each container fill. A no bottle no fill valve is used to make sure that a container is positioned beneath the filling head before permitting liquid to be ejected from the filling head. The pilot valve conduit can advantageously be monitored by other control mechanisms on the filling machine to indicate when a filling operation has begun. An external line can be connected into the blow down circuit to shut off the filling operation and switch to the blow down operation. In this manner, a separate control based on volume of fluid or weight of fluid may be employed in a manner which is allowed to override the operation of the back pressure control.

Other objects and advantages of the invention will become apparent during the following description of the presently preferred embodiments of the invention taken in conjunction with the drawings.

DETAILED DESCRIPTION OF THE PREFERRED EMBODIMENT

Figure 1:
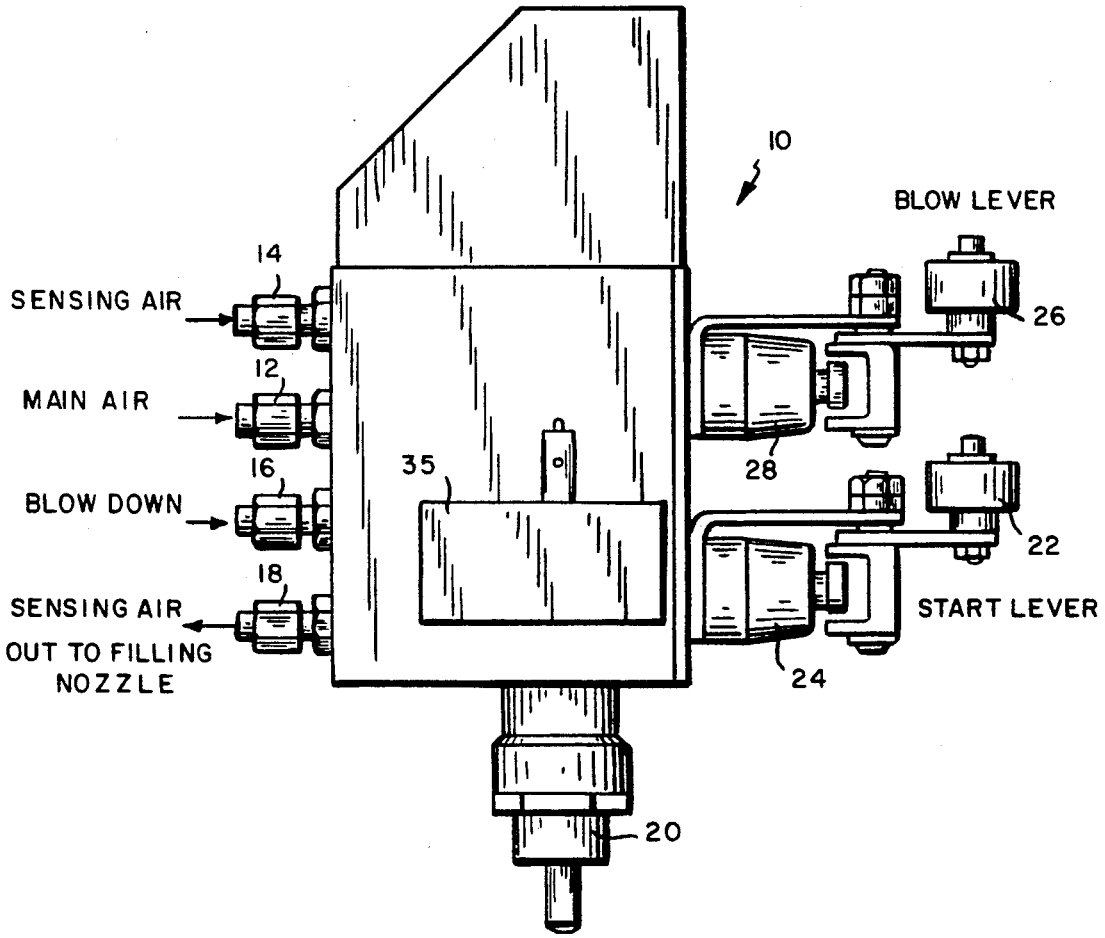
FIG. 1 is an outside view of the pneumatic control unit of the present invention.

Referring now to FIG. 1, the pneumatic control unit of the present invention is provided with three inlets for air supplies. The main control air attaches to nozzle 12. The main air, as presently preferred, is set to a gauge pressure of 60 psi. Sensing air is provided through nozzle 14. As presently preferred, the sensing air is set to a gauge pressure of 5 psi. The pressure of the sensing air is set low enough to avoid bubbling the liquid in the top of a container being filled while being high enough to reliably build a back pressure when the liquid fills the container. Blow down air is provided through nozzle 16 at a gauge pressure of about 20–40 psi. The pressure of the blow down air is set high enough to be useful in cleaning out the filling head after each fill operation. The control unit 10 is provided with a fourth nozzle 18 through which the sensing air from the control unit is directed into a sensing tube to a location directly above the top of the container being filled, as is well known in conventional filling machines. The nozzle 18 may also be used to expel blow down air for cleaning out the sensing tube after each fill.

Extending out through the bottom of the control unit is an air cylinder 20. The air cylinder is used to operate the material filling valve in the filling head in a conventional manner. Downward displacement of the air cylinder opens the material filling valve to permit liquid to be expelled into the container to be filled. A start lever 22 is provided on the control unit for mechanically actuating a start valve 24. The start valve 24 is a normally closed valve which is opened upon mechanical actuation. The presently preferred start valve is a two-way normally closed valve manufactured by Clippard Instrument Laboratories of Cincinnati, OH and having the model identification Clippard Minimatic MAV-2C.

The blow down operation is also mechanically actuated according to the presently preferred embodiment. A blow down lever 26 is provided for actuating a blow down valve 28. In accordance with the presently preferred embodiment, the blow down valve is a stem actuated three-way normally closed valve commercially identified as a Clippard Minimatic MAV-3C valve.

The pneumatic control circuit of the control unit 10 is formed in a manifold. Holes are drilled and channels are milled in the manifold to accommodate the valves of the circuit and to form the conduits between those valves. The presently preferred manifold is formed in a block of aluminum. In order to avoid the need for gaskets or screws to hold the manifold together, an aluminum side plate is fused to the drilled out aluminum block by use of vacuum brazing.

Figure 2:
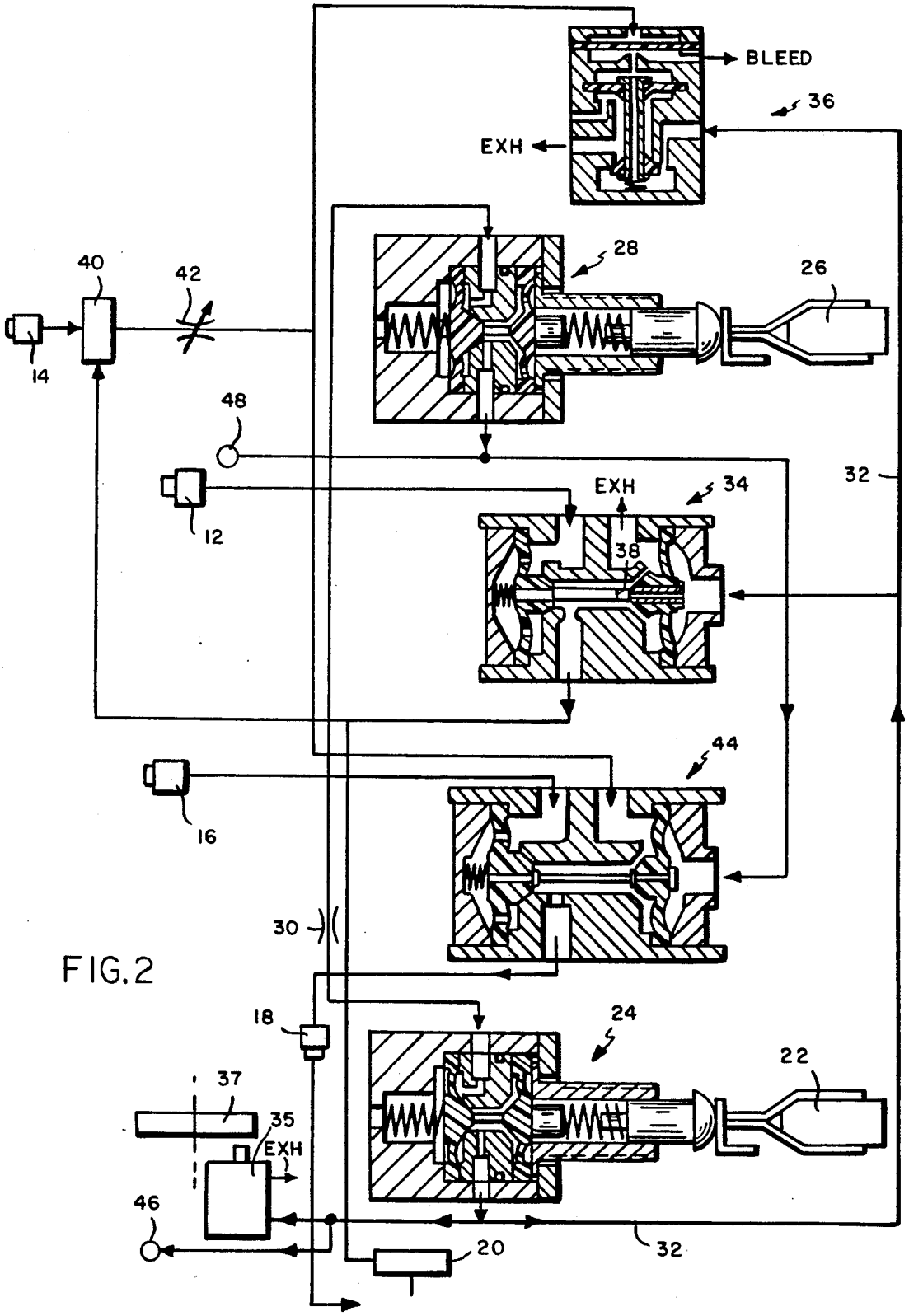
FIG. 2 is a schematic diagram of the control unit of the present invention.

Referring now to FIG. 2, the control circuit of the control unit 10 of the present invention will be described in detail. The start lever 22 actuates the start valve 24. The start valve 24 receives the main high pressure air. The valve is normally closed preventing the air from passing through. Actuation of the start valve 24 permits the high pressure air out into a pilot air conduit 32. The air in the pilot air conduit 32 is referred to as the high pressure pilot air. The high pressure pilot air is conducted into a no bottle no fill safety valve 35. The no bottle no fill valve is of well known construction and works in conjunction with a guide mechanism 37. The no bottle no fill valve of the presently preferred embodiment is a Clippard bleed valve Model CS-185 screwed onto the outside of the control unit manifold. An O-ring gasket is used in the attachment to the pilot air conduit to prevent any leaks. The guide mechanism 37 responds to the presence or absence of a container in the fill station to open and close the no container no fill valve 35. If a bottle is not in proper position for receiving liquid, the valve 35 will be in a position so as to exhaust the pilot air from the conduit 32 thereby preventing the material filling valve from becoming actuated. In order to prevent an excess of pilot air from exceeding the exhausting capacity of the no bottle no fill valve, a fixed orifice flow restrictor 30 is inserted on the main air line into the start valve 24. The flow resistor 30 restricts the volume of air provided from the main air supply through the start valve 24 into the pilot conduit. The presently preferred orifice is fixed at about a 0.76 mm. (0.030 inch) diameter.

In accordance with the present invention, the pilot air is provided to both a pilot valve 34 and a low pressure piloted valve 36 such as an interface valve. The pilot valve 34 has a normally closed poppet valve. The pilot air opens the poppet valve thereby permitting the main air to actuate the air cylinder 20. The air cylinder 20 operates the material filling valve (not shown) to begin the liquid filling operation. It is preferable that the pilot valve 34 include a compensating orifice 38 in the side of the poppet stem which opens into a passageway in the stem which leads out beyond a valve diaphragm into the pilot air chamber. When the pilot valve is in the open position, a portion of the main air passes through the compensating orifice 38 into the pilot air chamber to help hold the valve open. The main air through the compensating orifice compensates for any leaks present in the pilot system. For example, some air is bled out of the pilot conduit through a small bleed orifice of about 0.25 mm. (0.010 inch) in the interface valve 36. A drop in the pilot air pressure will close the pilot valve 34. Once closing begins, main air from the conduit to air cylinder 20 is exhausted through the pilot valve 34 through the exhaust port. Some pilot air may also be exhausted through the stem passageway and out through the compensating orifice. Thus, the air piloted valve 34 reacts quickly to a drop in pilot pressure to stop the liquid filling operation. The air piloted valve 34 of the presently preferred embodiment is a cartridge insert "AA" three-way valve Model No. Y125INAA, manufactured by Humphrey Products Co. of Kalamazoo, MI.

The low pressure piloted valve 36 is used to quickly trigger the shut off of the liquid filling operation in response to back pressure from the container being filled. The low pressure piloted valve of the presently preferred embodiment is a Clippard Minimatic 2010 interface valve. The interface valve 36 operates on the principle of imbalance. The pilot air pressure from the pilot air conduit 32 is applied to the normally closed side of the valve. Pilot pressure is also fed through a small orifice of about 0.25 mm. (0.010 inch) diameter in the stem of the interface valve to a lower side of the top diaphragm and is vented through a bleed orifice. The interface valve 36 is actuated by application of the back pressure to the large surface of the top diaphragm. The diaphragm is moved against a small orifice through which pilot air was passing out to the bleed orifice. The air jet from the small orifice is closed off by the low back pressure spread over the surface area of the diaphragm. Pilot air passing through the stem then builds up on the large diaphragm surface attached to the poppet valve. This pushes the poppet to the open position. Thus, application of a back pressure control signal through the pilot orifice of the interface valve opens the valve causing pilot air to be exhausted out through the valve. This causes an abrupt reduction in pressure in the pilot air conduit 32 which closes the pilot valve 34 and exhausts main air from the air cylinder 20 halting the liquid filling operation. The closed pilot valve cuts off further supply of main air to the air cylinder 20.

The sensing air is used for producing the control signal to the interface valve 36. The sensing air from nozzle 14 may be input into an optional three way normally closed valve 40. In the presently preferred embodiment, this optional valve 40 is a single air piloted three way with push turn valve manufactured by the Automatic Valve Company of Novi, MI and identified as Model No. B7136-027. The sensing air valve 40 is opened by the main air supplied through the pilot valve 34. The sensing air valve closes when the pilot valve 34 closes and filling stops. By closing off the sensing air, valve 40 avoids bubbling of the liquid by the sensing air.

During filling, the sensing air is passed through a variable flow restrictor 42. The variable flow restrictor 42 of the presently preferred embodiment is variable restrictor Model No. F-2822-41, manufactured by Air Logic of Racine, WI. The variable flow restrictor 42 permits accurate regulation of the pressure of the sensing air. The sensitivity to product height in a container can be adjusted by simply adjusting the opening of the variable flow restrictor 42. In this manner, a plurality of control units on a mass production filling machine can all be set to fill containers to the same product height.

At the start of the filling operation the sensing air is passed through an exhaust port in a three way normally closed valve 44. The normally closed valve 44 is also connected to the source of blow down air. The three way normally closed valve 44 of the presently preferred embodiment is Model No. Y125INA, manufactured by Humphrey Products Co. The sensing air continues through the valve 44 out through nozzle 18 into a sensing tube to the top of the container being filled in a conventional manner. With the container empty the sensing air easily passes out through the sensing tube. At a predetermined level, the liquid contacts the sensing tube. A back pressure is created through the sensing air conduit causing sensing air pressure to be applied to interface valve 36.

The blow down operation to clear the sensing tube is mechanically actuated momentarily after each fill operation. The mechanical blow down lever 26 is coupled to a blow down valve 28. The blow down valve is a stem actuated three way normally closed valve. Main air is connected to a normally closed port of the blow down valve 28. When the blow down valve is actuated, a blast of main air is provided out through the valve and to the normally closed valve 44. The main air opens valve 44 momentarily to permit a short blast of blow down air from the nozzle 16 to pass out through the sensing nozzle 18 to the sensing tube.

In accordance with the present invention, signals can be taken from the control unit 10 for use in an alternate control such as a volumetric fill based on the volume of fluid rather than the relative height of the fluid in the container. The pilot air conduit 32 can be tapped by an output port 46. The pilot air conduit 32 is maintained at approximately the pressure of the main air since air lost through the bleed orifice of the interface valve 36 is restored through the stem of the pilot valve 34. Thus, port 46 can be used to provide a signal when the filling operation starts and main air is first provided through the start valve 24 into the pilot air conduit 32 as well as a control signal when pilot air pressure is lost due to actuation of the interface valve 36. Thus, a connection to the port 46 provides an indication when the filling operation starts and stops.

A charge port 48 may be provided to give the alternate control the ability to override the product height control unit 10 and shut off the flow of liquid. If high pressure air is blown into the charge port 48, the normally closed valve 44 will open and blow down air will be substituted for the sensing air in the sensing conduit. The sensing air will be blocked by valve 44 and redirected to the interface valve 36. The gauge pressure of the sensing air must be kept below about 5 psi. to avoid damage to the upper diaphragm of the interface valve 36. The sensing air actuates the interface valve 36 thereby exhausting the pilot air and closing the pilot valve 34. This will shut off the material filling valve through the air cylinder 20. The alternate volumetric fill controller can thus hold the material filling valve closed, while its volumetric chamber is refilled with liquid.

Of course, it should be understood that various changes and modifications to the preferred embodiment described above will be apparent to those skilled in the art. It is therefore intended that those changes which can be made without departing from the spirit and the scope of the invention and without diminishing its attendant advantages shall be covered by the following claims.

I claim:

1. A pneumatic circuit for controlling the supply of product to a container comprising:

a source of main air at an operating pressure;

a pilot air conduit for conducting pilot air at a high pressure near in magnitude to said operating pressure;

pilot air means for allowing high pressure air into said pilot air conduit;

pilot valve means, connected to said pilot air conduit and coupled to said main air source, having an open position in response to high pressure pilot air in said pilot air conduit in which position said pilot valve means permits main air through to actuate supply of product to said container and having a closed position responsive to a drop in pressure in said pilot air conduit in which position supply of product to said container is discontinued;

a supply of sensing air at a pressure lower than said operating pressure and said high pressure;

product level sensor means coupled to said low pressure sensing air for providing a low pressure back pressure signal in response to product in a container being filled;

a back pressure piloted valve connected to receive said low pressure back pressure signal as generated by said product level sensor and connected to said pilot air conduit, said back pressure piloted valve being arranged to respond to said back pressure signal by exhausting said high pressure pilot air from said pilot air conduit so as to cause a drop in pressure in said pilot air conduit.

2. The pneumatic control circuit of claim 1 wherein said pilot valve means comprises a normally closed valve piloted by said high pressure pilot air.

3. The pneumatic control circuit of claim 2 wherein said pilot valve means includes a compensating orifice through which main air passes when said pilot valve means is in the open position to mix with the pilot air for holding said valve in the open position.

4. The pneumatic control circuit of claim 3 further comprising an output port for providing external access to air pressure from said pilot air conduit.

5. The pneumatic control circuit of claim 1 wherein said supply of sensing air is at a pressure low enough to avoid damage to said back pressure piloted valve means, a sensing tube coupled to said supply for positioning within said container and a conduit coupled to said supply and said sensing tube for conducting the back pressure signal to said back pressure piloted valve means.

6. The pneumatic control circuit of claim 5 further comprising a supply of blow down air at a pressure higher than the pressure of the sensing air and lower than the pressure of the pilot air and valve means connected to said sensing tube for selectively directing said blow down air or said sensing air into said sensing tube.

7. The pneumatic control circuit of claim 6 further comprising a charge port connected to said selectively directing valve means into which air can be injected to pilot said valve means to close off said valve means to sensing air such that said sensing air actuates said back pressure piloted valve means.

8. A pneumatic circuit for controlling the supply of product to a container comprising:

a source of main air at an operating pressure;

a pilot air conduit for conducting pilot air at a high pressure near in magnitude to said operating pressure;

pilot air means for allowing high pressure air into said pilot air conduit;

pilot valve means, connected to said pilot air conduit and coupled to said main air source, having an open position in response to high pressure pilot air in said pilot air conduit in which position said pilot valve means permits main air through to actuate supply of product to said container and having a closed position responsive to a drop in pressure in said pilot air conduit in which position supply of product to said container is discontinued;

a supply of sensing air at a pressure lower than said operating pressure and said high pressure;

a sensing tube for providing a back pressure signal coupled to said supply of sensing air for insertion into said container;

a conduit coupled to said supply of sensing air and said sensing tube for conducting the back pressure signal to said back pressure piloted valve means;

a back pressure piloted valve connected to receive said back pressure signal and connected to said pilot air conduit, said back pressure piloted valve being arranged to respond to said back pressure signal by exhausting said high pressure pilot air from said pilot air conduit so as to cause a drop in pressure in said pilot air conduit; and a variable flow restrictor connected to said supply of sensing air for adjusting the flow of the sensing air to set the product level at which supply of product to said container is discontinued.

9. The pneumatic control circuit of claim 8 wherein said pilot valve means comprises a normally closed valve piloted by said high pressure pilot air.

10. The pneumatic control circuit of claim 9 wherein said pilot valve means includes a compensating orifice through which main air passes when said pilot valve means is in the open position to mix with the pilot air for holding said valve in the open position.

11. The pneumatic control circuit of claim 10 further comprising an output port for providing external access to air pressure from said pilot air conduit.

12. The pneumatic control circuit of claim 8 further comprising a supply of blow down air at a pressure higher than the pilot air and valve means connected to said sensing tube for selectively directing said blow down air or said sensing air into said sensing tube.

13. The pneumatic control circuit of claim 12 further comprising a charge port connected to said selectively directing valve means into which air can be injected to pilot said valve means to close off said valve means to sensing air such that said sensing air actuates said back pressure piloted valve means.

* * * * *